US006769950B1

(12) United States Patent
Suciu

(10) Patent No.: US 6,769,950 B1
(45) **Date of Patent: *Aug. 3, 2004**

(54) WIND OPERATED TOY IN THE SHAPE OF A FISH OR THE LIKE

(76) Inventor: Emil Suciu, 66 Judith Crescent, Brampton, Ontario (CA), L6S 3J4

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/073,191

(22) Filed: May 6, 1998

(51) Int. Cl.[7] ..... G09F 19/00; G09F 17/00

(52) U.S. Cl. ..... 446/176; 446/199; 446/487; 73/170.05; 40/412; 40/422; 116/173

(58) Field of Search ..... 446/153, 176, 446/199, 201, 487; 73/170.05, 170.07, 170.09; 40/412, 413, 422, 218; D11/173, 165, 166, 168, 170, 172, 171, 181; D22/133; 116/173, 175; 244/153 R

(56) References Cited

U.S. PATENT DOCUMENTS 1,159,056 A * 2/1915 Lundborg et al.
1,142,708 A * 6/1915 Hill
1,557,644 A * 10/1925 Andersen
2,685,145 A * 8/1954 Dean
3,969,837 A * 7/1976 Kresse ..... 40/126 R
3,995,580 A * 12/1976 Serrone ..... 116/173
4,110,818 A * 8/1978 Hempsey
4,227,406 A * 10/1980 Coffey ..... 73/188
D264,065 S * 4/1982 Ornatek
D265,074 S * 6/1982 Ornatek ..... D11/166
4,578,888 A * 4/1986 Gomez ..... 40/411
4,679,523 A * 7/1987 Orero et al. ..... 116/173
4,718,190 A * 1/1988 Ward et al. ..... 43/17
5,406,734 A * 4/1995 Ho et al. ..... 43/17.1
6,050,017 A * 4/2000 Barry ..... 43/2
6,063,459 A * 5/2000 Velte ..... 428/31

FOREIGN PATENT DOCUMENTS

JP 09 244565 A 9/1989

* cited by examiner

*Primary Examiner*—Robert A. Hafer
*Assistant Examiner*—Laura Fossum

(57) ABSTRACT

The present invention relates to a wind operated device in the shape of a fish or the like. The device comprises at least two generally planar or segmented constructions of a light-weight material, each of the segments being flexibly connected to the other and a support rod connected to one of the segments by means of a bearing for supporting of the said device. When the device is subjected to an air-stream the segments move in a generally sinuous pattern in imitation of motion of a fish or the like while at the same time indicating wind direction.

9 Claims, 3 Drawing Sheets

WIND OPERATED TOY IN THE SHAPE OF A FISH OR THE LIKE

FIELD OF THE INVENTION

The present invention relates to wind operated toys or lawn ornaments and in particular wind operated toys or lawn ornaments in the shape of a fish or the like. In particular, the present invention relates to a toy or lawn ornament which when subjected to an air-stream, the motion of the toy imitates the swimming motion of a fish while at the same time indicating wind direction and qualitatively, airspeed.

BACKGROUND OF THE INVENTION

There are at present, numerous designs for lawn ornaments and toys and the like which are designed to move when subjected to an air-stream. Typical of such devices are pinwheels and other similar structures employing bladed propellers. Additionally, numerous pendants and wind direction devices are known.

SUMMARY OF THE INVENTION

The present invention relates to a wind operated device in the shape of a fish or the like. The device comprises at least two generally planar or segmented constructions of a lightweight material, each of the segments being flexibly connected to the other and a support rod connected to one of the segments by means of a bearing for supporting of the said device. When the device is subjected to an air-stream, the segments move in a generally sinuous pattern in imitation of motion of a fish or the like while at the same time indicating wind direction.

In an aspect of the invention, the device is in the shape of an angelfish comprised of three segments flexibly connected together.

In yet another aspect of the invention, the device is in the shape of a tadpole having three sections.

In yet another aspect of the invention, the wind operated device in the shape of a fish or the like comprises a generally planar body in the shape of a fish or the like, the body, when subjected to an airstream, being capable of moving in a generally sinuous pattern in imitation of the motion of a fish or the like. The body in the front region is connected to a support rod by means of a bearing for supporting the body.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
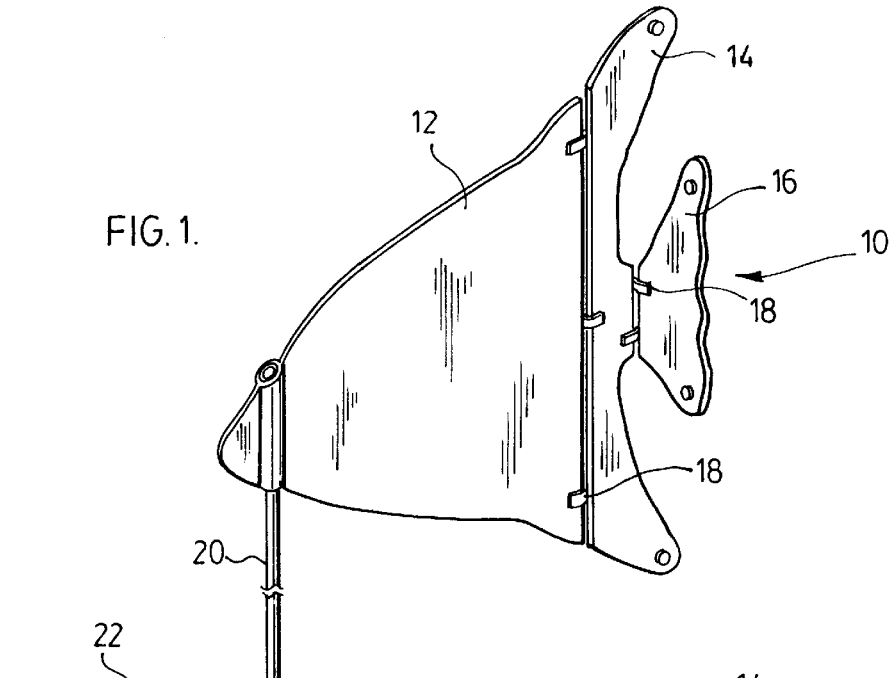
FIG. 1 is a perspective view of a first preferred embodiment of a device of the present invention.
Figure 2:
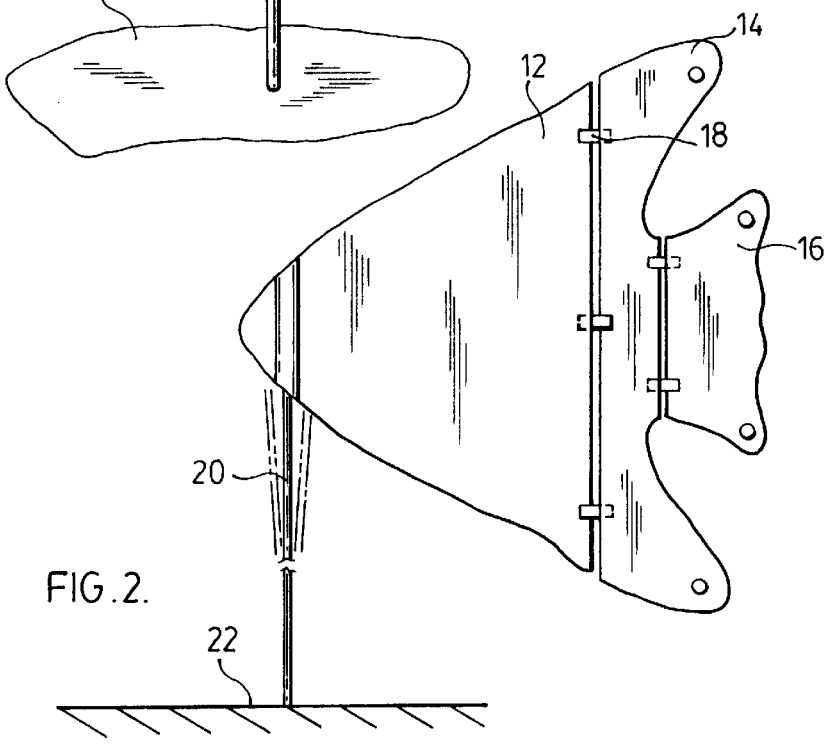
FIG. 2 is a side elevation view of the device in FIG. 1.
Figure 3:
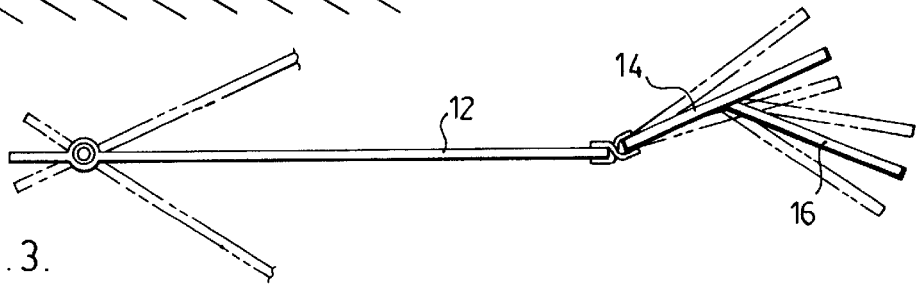
FIG. 3 is a top plan view of the device of FIG. 1.

FIG. 1 illustrates a first preferred embodiment of a device of the present invention indicated generally at the numeral 10. The device comprises three segments 12, 14 and 16 flexibly connected together by hinged means 18. While the device as shown in FIG. 1 as in the general shape of an angelfish with segment 12 making up the main body of the fish, segment 14 the dorsal and ventral fins of the fish, and segment 16 the tail fin of the fish, other shapes are possible. Device 10 is supported by a support rod 20, connected near the front of segment 12 although other points of attachment are possible, as explained below. The main body 12 is free to rotate about the flexible shaft 20 by means of the bearing. When the device is used as a lawn ornament, the support rod 20 is attached to the ground 22. When the device 10 is to be used as a hand-held toy, the support rod 20 is held with the hand.

The motion of the device 10 in the shape of a fish when subjected to an air-stream is illustrated in the figures. When the airstream impinges upon the device 10 each of the individual segments 12, 14 and 16 are free to move about the hinges 18 and the preferred embodiment support rod 20, is in itself flexible providing for fore and aft and side to side bending and proportional degrees of freedom thereby increasing further the sinuous motion of the fish which closely resembles the motion of the real thing.

Figure 4:
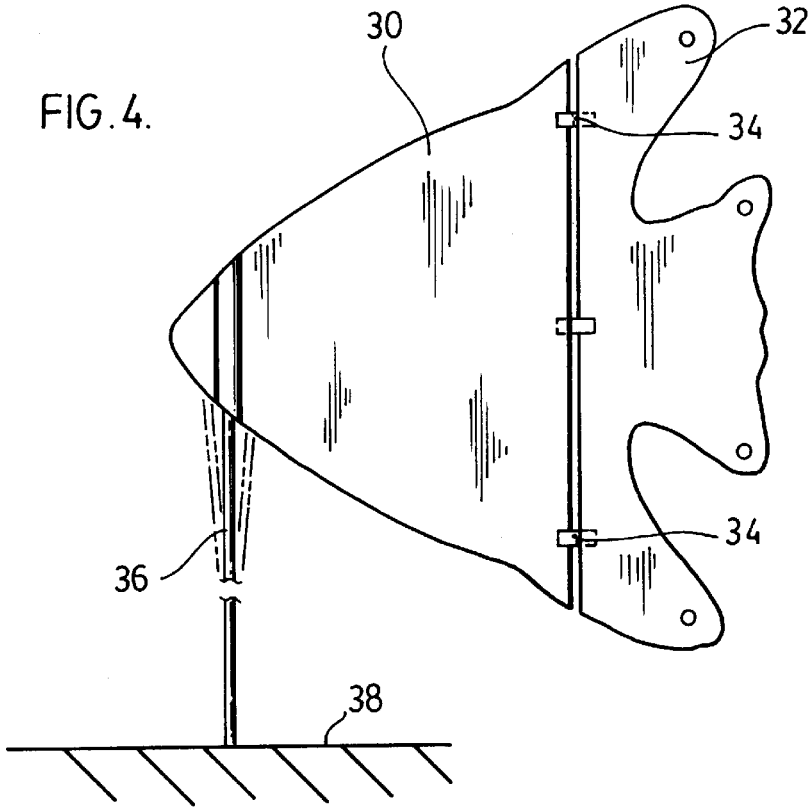
FIG. 4 is a side elevation view of a second embodiment of the device of the present invention.
Figure 5:
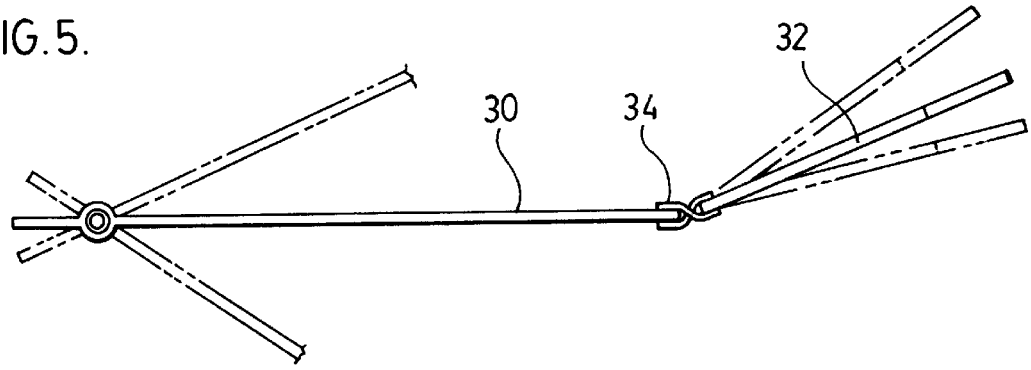
FIG. 5 is a top plan view of the device of FIG. 4.

A second embodiment of a device of the present invention is illustrated in FIGS. 4 and 5. This embodiment has only two segments 30, 32 which are held together by hinges 34. Similar to the first embodiment, this device is supported by support rod 36, which may be attached to the ground 38. Segment 30 is free to rotate about the flexible shaft, thus permitting the device to follow the wind direction.

Figure 6:
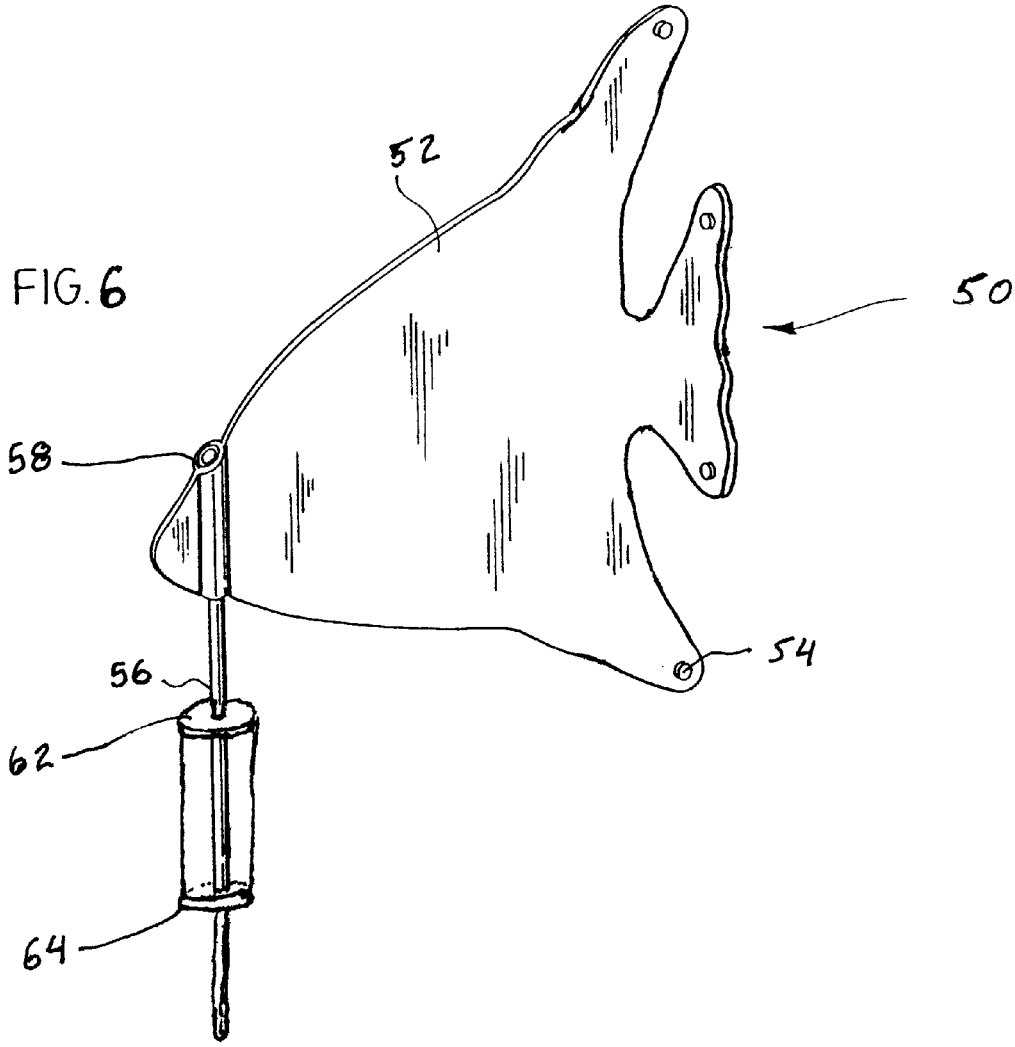
FIG. 6 is a side elevation view of a third embodiment of a device of the present invention.

A third embodiment of a device of the present invention is illustrated in FIG. 6 generally indicated by the numeral 50. The body 52 of this device 50, similar to the other embodiments is in the shape of an angelfish. The body 52 is provided as one continuous segment, having flexible properties to allow it to have the sinuous motion when impinged by an airstream. This may be achieved by constructing the body of a relatively flexible material, preferably a suitable polymeric material such as flexible polypropylene or polyethylene. The body, while being flexible, should still have sufficient stiffness to maintain the generally fish shape when at rest. The motion of the body may also be enhanced by providing suitably placed weighted regions 54 in the area of the fins to increase sinuous motion in these regions.

The body 52 of the third embodiment is supported by a support rod 56 connected to the body through a bearing 58. The embodiment of the device shown in FIG. 6 is provided with a holder 60 for holding the device in the hand. Holder 60 is provided with top and bottom sliders 62 and 64 which hold the support rod 56 and allow its free length to be adjusted by moving the holder 60 up and down. The frequencies of oscillation of the body 52 and the imitation of the motion of a fish may be altered by lengthening and shortening the flexible support rod 56 by adjusting the free length of the support rod 56 by sliding the holder 60 along the support rod.

The devices of the present invention are preferably made of very light materials with the individual segments manufactured from materials such as balsa wood or styrofoam. The hinges are made of a material to provide some flexibility to influence the rotational motion of the segments about the hinge lines. The body segment may be beveled at the adjoining hinge edges to provide for means of limiting the amplitude of the segment rotation. In addition, the stiffness of the supporting rod can be tailored and, in combination with installation of balance weights 24 or 40 on the segment extremity and hinge flexibility variation, motion patterns can be appreciably modified in the motion of other fish or the like. For example, a darting tadpole can also be reproduced with the properly shaped body, flexible support rods, stiffness tailoring and balance weights installation.

As mentioned above, the device may be connected to the support rod at places other than at the front of the body. The support may be connected to the body anywhere within the front half of the body. Depending upon the location of the connection of the support to the body, the character of the motion will vary.

The preferred embodiments illustrated in the application utilize a support rod for supporting the device. The device could also be supported by attachment to a string suspended between two supports. The string would be provided with one or more suitable stops to hold the bearing in the proper vertical position while allowing the full motion of the body.

The device of the present invention may be provided with decorative and/or colored covering for aesthetic purposes. Such decorative or colored covering may also function to hide the body segments and hinges. In addition, to provide for a more uniform appearance, the hinges providing rotational stiffness may be built into a continuous body with proper elastic properties tailoring.

Although various preferred embodiments of the present invention have been described herein in detail, it will be appreciated by those skilled in the art, that variations may be made thereto without departing from the spirit of the invention or the scope of the appended claims.

What is claimed is:

1. A wind operated device in the shape of a fish comprising at least two generally planar segments constructed of a lightweight material having sufficient stiffness to maintain its shape at rest, said segments being flexibly connected one to the other;

one of said segments being rotatably connected to a support rod through a bearing, said support rod being flexible to permit fore and aft and side to side bending;

whereby when said device is subjected to an airstream, the combination of the bending of said flexible support rod, the rotation of said segment about said bearing and the flexible connection of said segments to one another allow said segments to move in a sinuous motion in imitation of the motion of a fish.

2. A wind operated device as claimed in claim 1, wherein said device is in the shape of an angelfish.

3. A wind operated device as claimed in claim 2, wherein the device comprises three segments, a first segment, a second segment and a third segment.

4. A wind operated device as claimed in claim 3 wherein the support rod is connected to the first segment.

5. A wind operated device as claimed in claim 4 wherein the support rod is connected to the first segment forward of a vertical centerline of the first segment and the second segment is connected at a rear edge of the first segment.

6. A wind operated device as claimed in claim 5 wherein the segments are hingedly connected to one another.

7. A wind operated device as claimed in claim 6 wherein at least one of the second and third segments are provided with weighted regions near an edge of the segment to modify the sinuous motion of the segments.

8. A fish shaped wind operated device comprising a fish shaped planar body of a flexible material having sufficient stiffness to maintain its planar shape at rest while having sufficient flexibility to allow the body to move in a sinuous pattern, the body in the front region being rotatably connected to a support rod through a bearing, the support rod being flexible to permit fore and aft and side to side bending, whereby when said device is subjected to an airstream, the combination of the bending of said flexible support rod, the rotation of said body about said bearing and the sinuous motion of said body allow said body to move in imitation of the motion of a fish.

9. A wind operated device as claimed in claim 8, wherein said device is in the shape of an angelfish.

* * * * *